US005901523A

United States Patent [19]

Tasi

[11] Patent Number: 5,901,523

[45] Date of Patent: May 11, 1999

[54] ASSEMBLY UNIT OF FRAME STRUCTURE

[76] Inventor: Hsiang Jung Tasi, 120, Ta Tarn, Shin Kang Shiang, Jia Yih Shyuan, Taiwan

[21] Appl. No.: 08/969,311

[22] Filed: Nov. 13, 1997

[51] Int. Cl.[6] ..... E04B 1/38; A47B 57/06; F16B 7/18

[52] U.S. Cl. ..... 52/653.2; 52/655.1; 52/656.1; 52/656.9; 403/231; 248/223.41; 248/225.11; 248/297.21

[58] Field of Search ..... 52/653.1, 653.2, 52/655.1, 656.1, 656.9, 73; 403/230, 231, 240; 248/223.41, 225.11, 297.21

[56] References Cited

U.S. PATENT DOCUMENTS 3,566,561 3/1971 Tozer .
3,901,612 8/1975 Canin ..... 403/189
5,154,385 10/1992 Lindberg et al. ..... 248/225.11
5,413,836 5/1995 Hsieh ..... 428/188

FOREIGN PATENT DOCUMENTS 244304 4/1947 Switzerland ..... 248/223.41

*Primary Examiner*—Robert Canfield
*Attorney, Agent, or Firm*—David and Raymond; Raymond Y. Chan

[57] ABSTRACT

The present invention provides an assembly unit of frame structure which comprises a column body, a cover body, and a fastening element. By assembling a predetermined number of the assembly units to incorporate with a plurality of supporting frame through an easy and prompt assembly process, a frame structure of desired shape can be quickly and easily constructed for use. The frame structure can be construct by the assembly unit of the present invention into various shape, such as rectangular shape or right triangular shape, without any special tools or technology.

7 Claims, 5 Drawing Sheets

ASSEMBLY UNIT OF FRAME STRUCTURE

FIELD OF THE PRESENT INVENTION

The present invention relates to a constructive frame work, and more particularly to an assembly unit of frame structure for constructing a supporting frame that can be easily adjusted to any height within the provided height of the column body and can be promptly and easily disassembled or re-assembled without worrying about the rigidity of the structure thereof.

BACKGROUND OF THE PRESENT INVENTION

The conventional structure of a supporting frame of any type is commonly constructed by angle irons (as shown in FIG. 1) as the assembly units. At both sides of the angle iron, two series of screw hole are evenly provided to enable a plurality of screws to secure the angle irons with each other to form the supporting frame. The adjustability of the frame is thus limited to the space between each screw hole provided on the angle iron, so that fine adjustment is impossible and not all the height requirement can be met. Moreover, when the user needs to re-adjust the height of the supporting frame, he or she must entirely unscrew all the connection screws to release all the lateral angle irons from the vertical angle irons and rescrew them to the vertical angle irons at desired height again. The adjusting operation is time consuming and really troublesome.

Since metal is the most common construction material for framework, after a certain period of time, rust may easily form on the surface of the framework due to the fact that the framework is unavoidably in contact with air and exploded under the radiance of the sunlight. Therefore the rigidity of the framework may seriously affect and the loading ability of the framework structure also decreases, that may relatively increase the chance of accident. Although the framework assembled by such angle irons can be assembled into various desired shapes by bending the angle irons to adequate shapes in order to fit the connection, it may simultaneously cause a defective that the loading ability of such framework structure would also be greatly lowered.

SUMMARY OF THE PRESENT INVENTION

The main objective of the present invention is to provide an assembly unit of the frame structure which can be adequately used for assembling into a framework having various predetermined shapes and structures.

Another objective of the present invention is to provide an assembly unit of frame structure for constructing a supporting frame that can be easily adjusted to any height within the provided height of the column body and can be promptly and easily disassembled or reassembled without worrying about the rigidity of the structure.

Another objective of the present invention is to provide an assembly unit of frame structure for constructing a supporting frame, in which the height of the frame structure can be adequately and easily adjusted by loosening the screwing connection between the column body and the fastening element positioned inside the T-shape groove of the column body to enable the fastening element sliding up and down with respect to the column until the desire height is reached. Whereby, the adjustment of the height of the frame structure does not require exact measurement or be limited by the distance between the screw holes of the conventional assembly unit such as angle iron. The desired height of the frame structure can easily be determined and locked up as long as the height of the frame structure lays on the available total length of the T-shape groove.

Another objective of the present invention is to provide an assembly unit of frame structure for constructing a supporting frame which can be constructed into any shape such as triangular or hexagonal other than the regular rectangular shape by selectively incorporating with specific connecting element having different shape. During the assembly process, if the supporting plates connected to the column body are not leveled at same height and do not have a slight height difference, the user can simply loosen the fastening screws and adjust the distance difference to re-level all the supporting plates to the same height. When the frame structure is no longer needed, the user can simply loosen the screws from each component to easily detach apart the frame structure. All the components of the assembly unit of the frame structure can be re-assembled the next time without worrying the structure safety of reconnection. The construction material of all the components of the assembly unit are made of aluminum alloy which has high rust resistance to reduce the possibility of rusting and increase the life span of the framework structure. Therefore, the unexpected framework structure failure due to the rigidity defect caused by rusting can be avoided.

Accordingly, an assembly unit of frame structure of the present invention comprises a column body, a fastening element, a connecting element, and two cover bodies. The column body is made of aluminum alloy, which has a long shaft shape and a T-shape groove coaxially and longitudinally provided on a connecting side thereof The two cover bodies each has an identical shape as a cross section shape of the column body and are covered on a top end and a bottom end of the column body. A protruding portion is protruded from a front surface of each of the cover bodies for engaging into a top end or a bottom end of the column body. The fastening element which has a screw hole centrally provided thereon is slidably positioned inside the T-shape groove of the column body. The connecting element comprises a supporting plate and a connecting plate downwardly and perpendicularly extended from the supporting plate. The supporting plate has a plurality of circular holes provided thereon and the connecting plate has a circular hole provided thereon. The connecting element is adjustably mounted on the connecting side of the column body by means of a screw which is passed through the circular hole of the connecting plate of the connecting element and screwed to the screw hole on a center of the fastening element inside the T-shape groove of the column body. The supporting plate is adapted for affixing two ends of at least two supporting frames respectively to form a predetermined including angle therebetween by screwing through the circular holes on the supporting plate with a predetermined number of screws.

DETAILED DESCRIPTION OF THE PREFERRED EMBODIMENT

Figure 1:
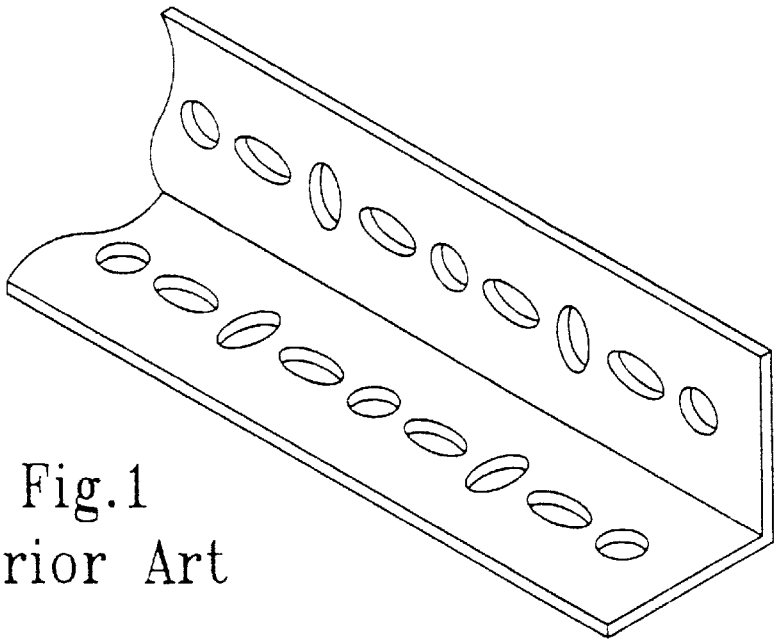
Fig.1 Prior Art
FIG. 1 illustrates a front view and an end view of a conventional angle iron.
Figure 2:
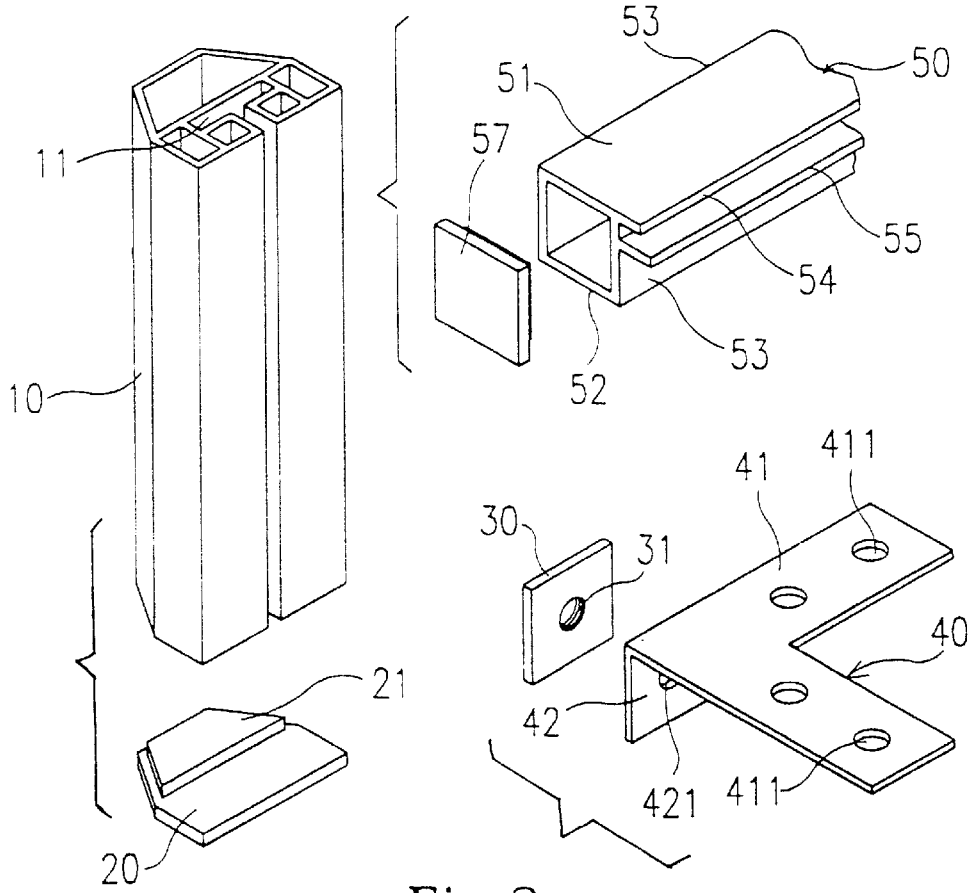
FIG. 2 is an exploded perspective view of an assembly unit according to a preferred embodiment of the present invention.

Referring to FIG. 2 to FIG. 8 of the drawings, an assembly unit of frame structure of the present invention comprises a column body 10 made of aluminum alloy having a long shaft shape and a T-shape groove 11 coaxially and longitudinally provided on a connecting side thereof, two cover bodies 20 having an identical shape as the cross section shape of the column body 10 for covering a top end and a bottom end of the column body 10 respectively wherein a protruding portion 21 is protruded from a front surface of each cover body 20 for engaging into the top end or the bottom end of the column body 10, a fastening element 30 which has a screw hole 31 centrally provided thereon being slidably positioned inside the T-shape groove 11 of the column body 10, a connecting element 40 having a supporting plate 41 and a connecting plate 42 downwardly and perpendicularly extended from the supporting plate 41, wherein the supporting plate 41 provides a plurality of circular holes 411 thereon and the connecting plate 42 provides a circular hole 421 thereon. The shape of the supporting plate 41 can be constructed as L-shape, V-shape or T-shape according to the desire shape of the frame structure such as rectangular shape, triangular shape or continuous frame shape, as shown in FIGS. 8*a* to 8*c* respectively. The connecting element 40 is adjustably mounted on the connecting side of the column body 10 by means of a screw 50 which is passed through the circular hole 421 of the connecting plate 42 of the connecting element 40 and screwed to the screw hole 31 disposed on the center of fastening element 30 within the T-shape groove 11 of the column body 10.

Figure 3:
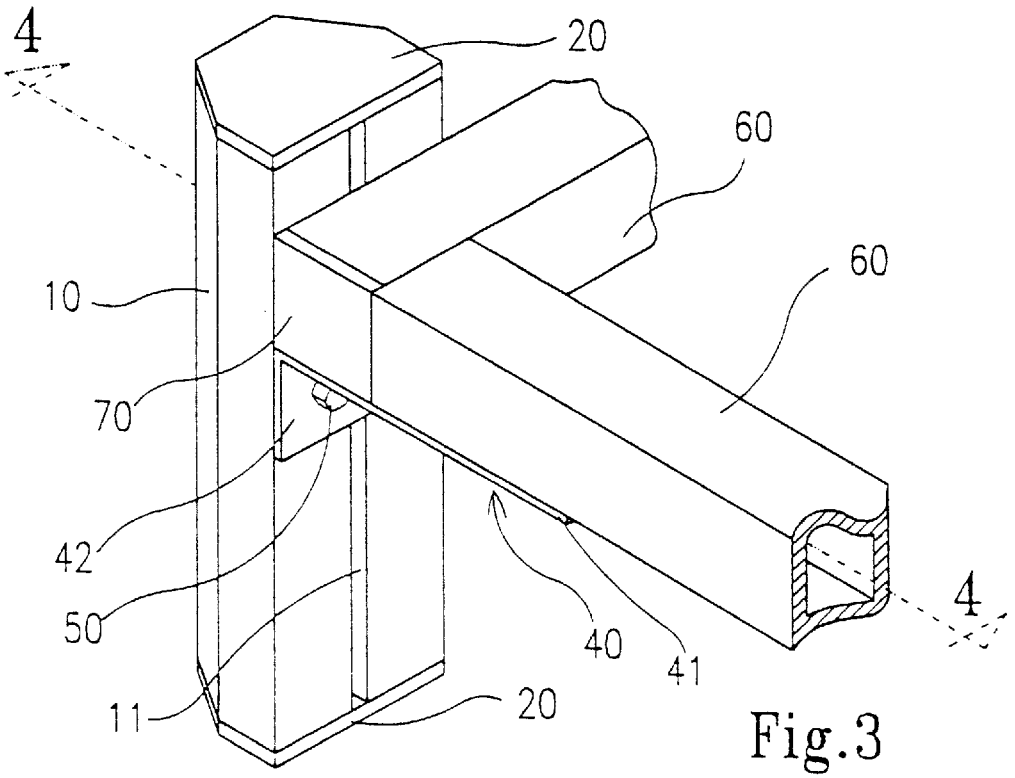
FIG. 3 is a partial perspective view of a frame structure assembled by the assembly unit according to the above preferred embodiment of the present invention.
Figure 4:
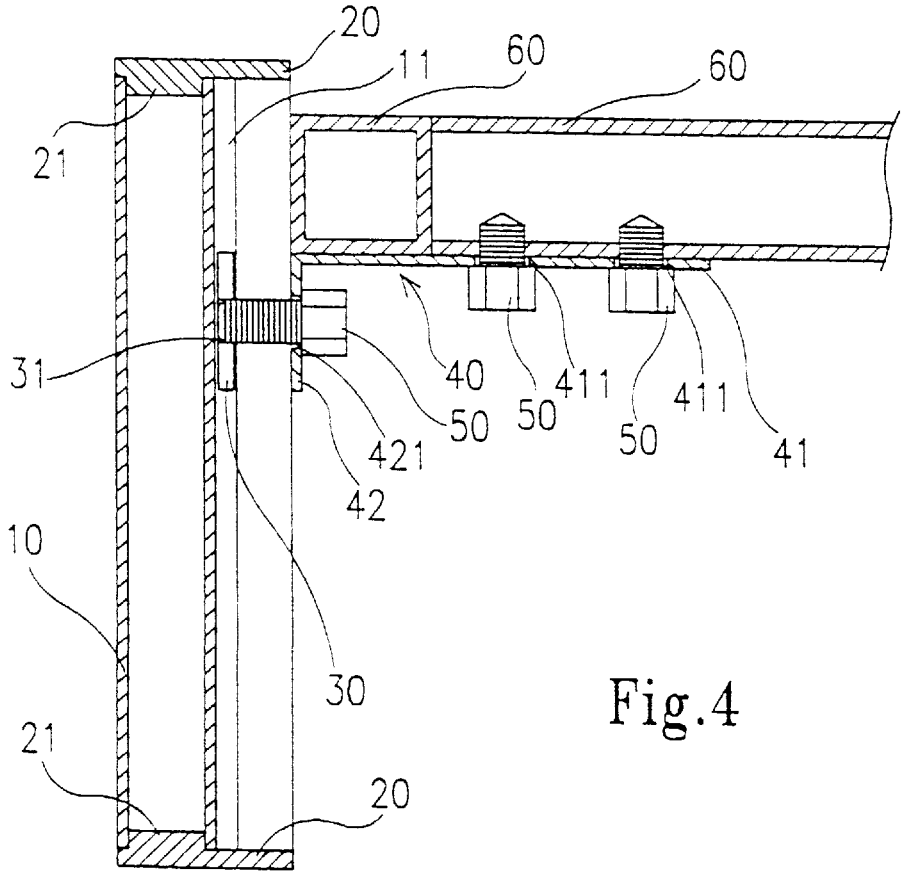
FIG. 4 is a partial sectional view of the frame structure assembled by the assembly unit according to the above preferred embodiment of the present invention.
Figure 5:
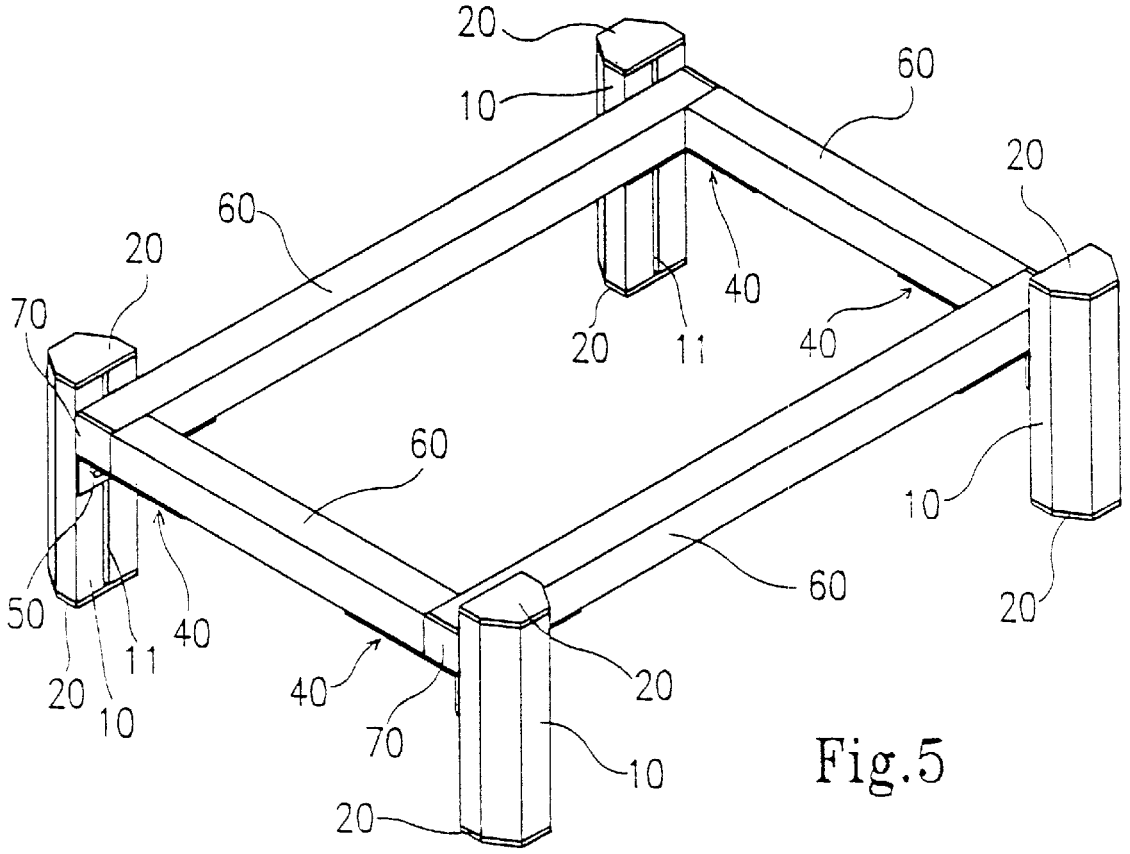
FIG. 5 is a perspective view of a rectangular frame structure assembled by four assembly units according to the above first preferred embodiment of the present invention.

Referring to FIGS. 3 to FIG. 5, there are two methods of assembling a frame structure with a plurality of assembly unit of the present invention. The first method includes the steps of positioning the column body 10 vertically; then mounting each connecting element 40 on the connecting side of the respective column body 10 by passing a screw 50 through the circular hole 421 on the connecting plate 42 and screwing to the screw hole 31 on the fastening element 30 disposed within the T-shape groove of the respective column body 10; and affixing a plurality of supporting frames 60 between each two connecting elements 40 mounted on two adjacent column bodies 10 respectively. Each end of each of the supporting frames 60 is affixed on the respective connecting element 40 by means of a screw 50 which is passed through each circular hole 411 of the supporting plate 41 of the respective connecting element 40 and screwed with the supporting frame 60. The shape of the final product is depended on the shape of the connecting elements 40 used and the connection manner between the supporting frame 60 and the column bodies 10.

The second method includes the steps of affixing the ends of all the supporting frames 60 on the supporting plates 41 of the connecting elements 40 to form a horizontal frame body with desired shape by having a plurality of screws passing through the circular hole 411 on each supporting plate 41 of each connecting element 40; mounting the connecting elements 40 to the column bodies 10 respectively by having a plurality of screws 50 passing through the circular holes 421 on the connecting plates 42 of the connecting elements 40 and screwing to the screw holes 31 on the fastening elements 30 respectively without tightening the screws 50; then positioning all of the column bodies 10 vertically and respectively inserting the fastening elements 30 of the supporting frame 60 into the T-shape grooves 11 of the column bodies 10 until a desire height is reached; and finally tightening all the screws 50 which pass through the circular holes 421 of the connecting plates 42 of the connecting elements 40 respectively to screw with the screw holes 31 of the fastening elements 30 respectively.

Figure 6:
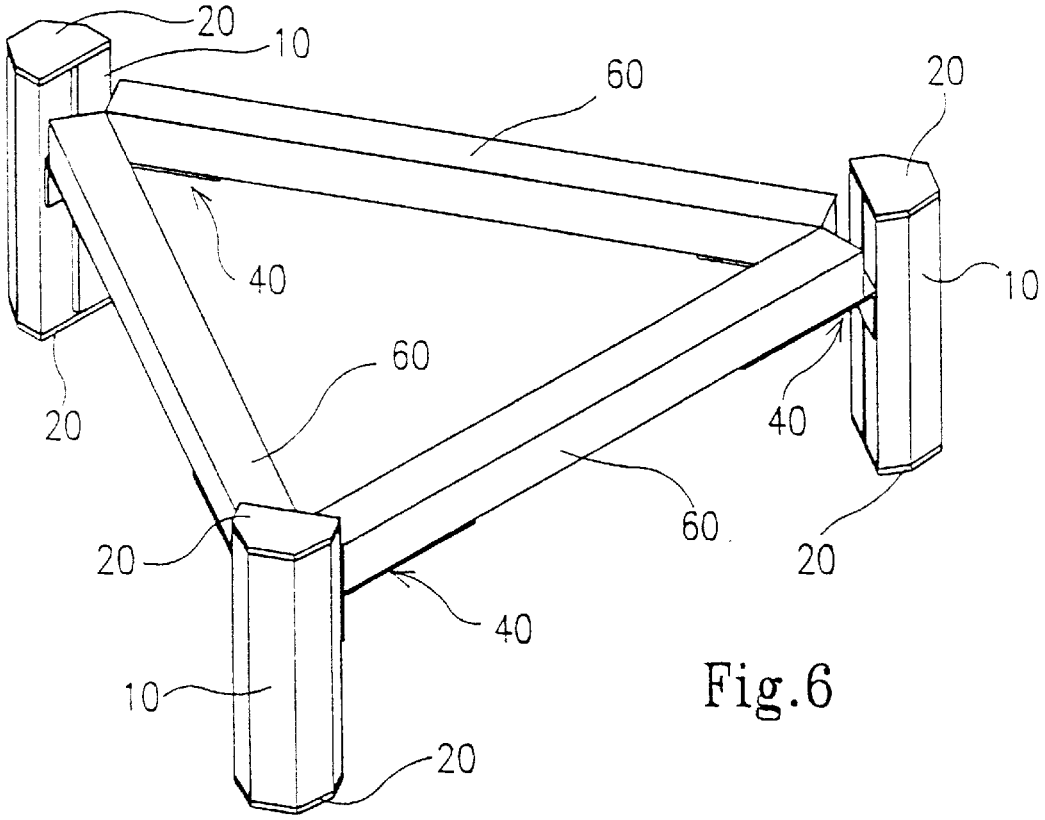
FIG. 6 is a perspective view of a triangular frame structure assembled by three assembly units according to the above preferred embodiment of the present invention.
Figure 7:
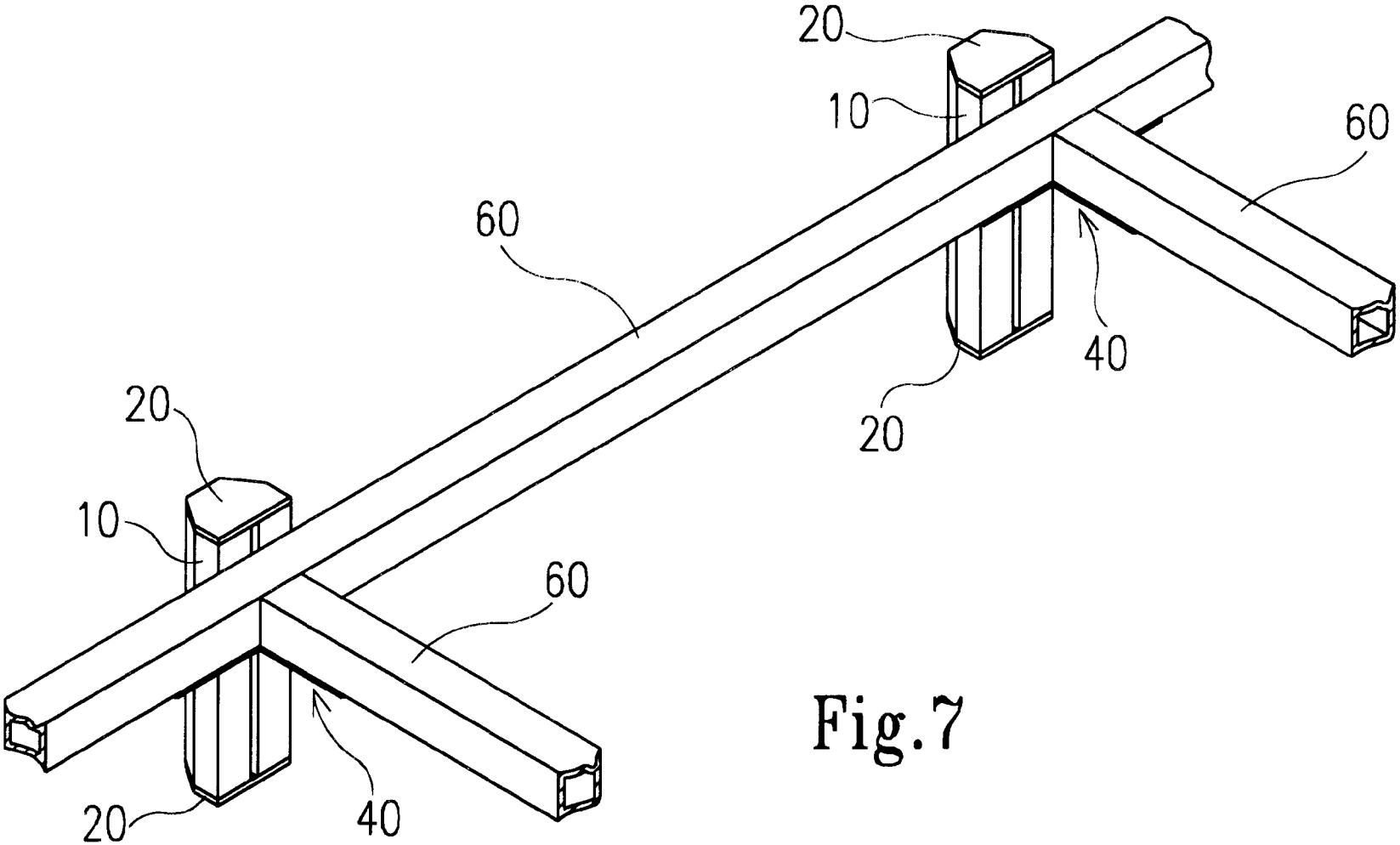
FIG. 7 is a perspective view of a continuous frame structure assembled by numerous of assembly units according to the above preferred embodiment of the present invention.
Figure 8A:
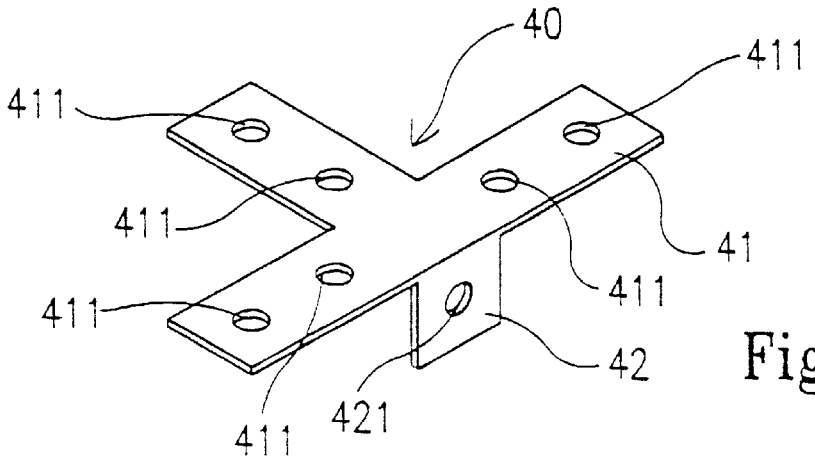
FIG. 8A illustrates a front view and an end view of a L-shape connecting element according to the above preferred embodiment of the present invention.
Figure 8B:
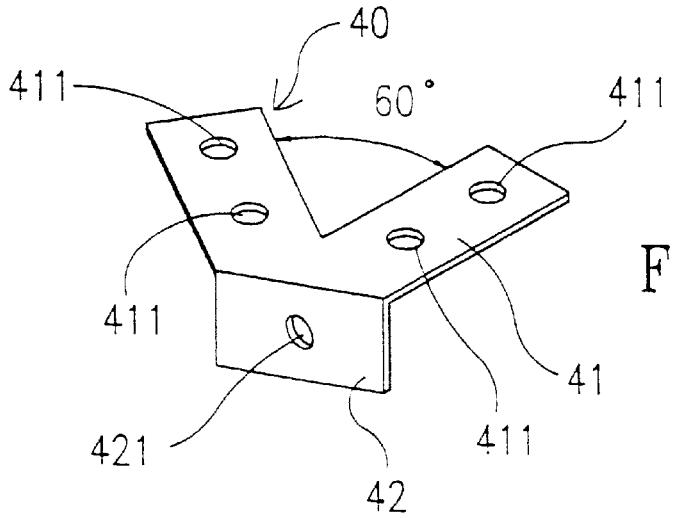
FIG. 8B illustrates a front view and an end view of a V-shape connecting element according to the above preferred embodiment of the present invention.
Figure 8C:
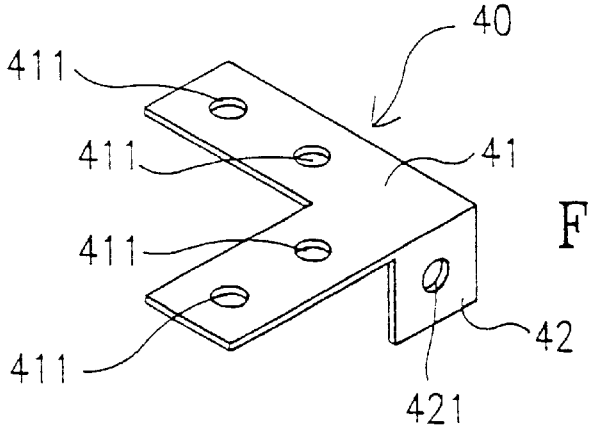
FIG. 8C illustrates a front view and an end view of a T-shape connecting element according to the above preferred embodiment of the present invention.

Referring to FIG. 6 to FIG. 7, the supporting plate 41 of the connecting element 40 of each assembly unit of the present invention can be constructed into any desired shape according to the necessity of the user, such as a right triangle frame (as shown in FIG. 6), the including angle between two sides of the supporting plate 41 is 60 degree apart, adapted to construct a triangular frame structure, as shown in FIG. 8B. Therefore, the present invention can construct into various frame structures with different shapes. If the frame structure needs to have horizontal extension, the supporting plate 41 of the connecting element 40 can be constructed into a T-shape (as shown in FIG. 8C), for connecting each section of the extension frame, as shown in FIG. 7. When the final frame product is constructed, a plurality of lip covers 70 are mounted on both ends of each supporting frame 60 respectively to improve the appearance and also prevent undesired particles to enter.

Furthermore, since different shaped connecting element 40 can be used in accordance with the desired shape of the frame structure, it increases the application limitation of the present invention. During the constructing process of the present invention, if the user finds out that the frame structure is slightly unbalance, the user merely needs to loosen the screws 50 and re-adjust the position of the connecting elements 40 and the fastening elements 30 until the frame structure is in perfect balance. The present invention solves the problems occurred in the conventional frame work, in which due to the height limitation of the predetermined screw holes provided on the angle iron that resulting in unable to finely adjust the height of the frame. The present invention can be easily adjusted to fit the desire height or flexibly adjusted with small increment to balance the frame work, and that the time consuming for constructing the frame structure according to the present invention is relatively short which makes the present invention very adequate for DIY (Do It Yourself).

Accordingly, the assembly unit of frame structure of the present invention is an improvement of the conventional frame work structure, in which a frame structure constructed by the assembly units of the present invention can be adjusted to any height within the total column body height in slight increment and be assembled to form any desired shape that is useful for the industry. Therefore, the present invention truly is a practical and novel improvement over the conventional frame work structure.

What is claimed is:

1. An assembly unit of frame structure, comprising:

a column body made of aluminum alloy having a long shaft shape and a T-shape groove coaxially and longitudinally provided on a connecting side thereof, two cover bodies each having an identical shape as a cross section shape of said column body and being covered on a top end and a bottom end of said column body, a protruding portion being protruded from a front surface of each of said cover bodies for engaging into said top end or said bottom end of said column body;

a fastening element which has a screw hole centrally provided thereon being slidably positioned inside said T-shape groove of said column body; and a connecting element comprising a supporting plate and a connecting plate downwardly and perpendicularly extended from said supporting plate, said supporting plate having two legs each having a plurality of circular holes provided thereon and said connecting plate having a circular hole provided thereon, said connecting element being adjustably mounted on said connecting side of said column body by means of a screw which is passed through said circular hole of said connecting plate of said connecting element and screwed to said screw hole on a center of said fastening element inside said T-shape groove of said column body, said supporting plate being adapted for affixing an end of at least two supporting frames respectively by screwing through said circular holes on said supporting plate with a predetermined number of screws to form a predetermined including angle therebetween.

2. An assembly unit of frame structure, as recited in claim 1, wherein said supporting plate of said connecting element is in V-shape.

3. An assembly unit of frame structure, as recited in claim 1, wherein said supporting plate of said connecting element is in T-shape.

4. An assembly unit of frame structure, as recited in claim 1, further comprising lip covers for mounting on ends of each of said supporting frames.

5. An assembly unit of frame structure, as recited in claim 2, further comprising lip covers for mounting on ends of each of said supporting frames.

6. An assembly unit of frame structure, as recited in claim 3, further comprising lip covers for mounting on ends of each of said supporting frames.

7. An assembly unit of frame structure, as recited in claim 1, wherein said supporting plate of said connecting element is in L-shape.

* * * * *